US012338811B2

(12) United States Patent
Benassi et al.

(10) Patent No.: US 12,338,811 B2
(45) Date of Patent: Jun. 24, 2025

(54) MEMBRANE-BASED PISTON PUMP AND A HOMOGENISING APPARATUS COMPRISING THE MEMBRANE-BASED PISTON PUMP

(71) Applicant: GEA MECHANICAL EQUIPMENT ITALIA S.p.A., Parma (IT)

(72) Inventors: Massimiliano Benassi, Parma (IT); Filippo Fontanesi, Parma (IT); Matteo Folezzani, Parma (IT)

(73) Assignee: GEA MECHANICAL EQUIPMENT ITALIA S.p.A., Parma (IT)

( * ) Notice: Subject to any disclaimer, the term of this patent is extended or adjusted under 35 U.S.C. 154(b) by 0 days.

(21) Appl. No.: 17/760,360

(22) PCT Filed: Feb. 21, 2022

(86) PCT No.: PCT/IB2022/051520
§ 371 (c)(1),
(2) Date: Aug. 8, 2022

(87) PCT Pub. No.: WO2023/007251
PCT Pub. Date: Feb. 2, 2023

(65) Prior Publication Data

US 2024/0209850 A1 Jun. 27, 2024

(30) Foreign Application Priority Data

Jul. 26, 2021 (EP) ..... 21187816

(51) Int. Cl.
*F04B 49/22* (2006.01)
*F04B 43/067* (2006.01)
(Continued)

(52) U.S. Cl.
CPC ..... *F04B 49/22* (2013.01); *F04B 43/067* (2013.01); *F04B 43/073* (2013.01);
(Continued)

(58) Field of Classification Search
CPC .... F04B 43/067; F04B 43/073; F04B 49/002; F04B 49/08; F04B 49/22; F04B 53/12; F04B 53/16
(Continued)

(56) References Cited

U.S. PATENT DOCUMENTS 5,085,468 A * 2/1992 Billotte ..... F15B 1/26 60/912
5,246,351 A 9/1993 Horn et al.
(Continued)

FOREIGN PATENT DOCUMENTS

DE 102014010108 A1 1/2016
JP H0471781 9/1996
(Continued)

OTHER PUBLICATIONS

International Search Report and Written Opinion received in International Application No. PCT/IB2022/051520, Feb. 5, 2022.

*Primary Examiner* — Philip E Stimpert
(74) *Attorney, Agent, or Firm* — Maschoff Brennan

(57) ABSTRACT

A piston pump including a membrane separating a product side from a hydraulic side for a hydraulic fluid, a reciprocating piston operatively active on the hydraulic fluid, and a valve system to establish a selective fluid communication between the hydraulic side and a tank containing the hydraulic fluid. The valve system includes a first valve arrangement that, in a working condition of the piston pump, is configured to discharge the hydraulic fluid having a pressure over a first threshold from the hydraulic side towards the tank and to draw the hydraulic fluid from the tank to the hydraulic side when a pressure in the hydraulic side dropping below a second threshold, and a second valve arrangement that, in at least one non-working condition of the piston pump, is configured to discharge the hydraulic fluid having a pressure
(Continued)

over a third threshold from the hydraulic side towards the tank.

16 Claims, 4 Drawing Sheets

(51) Int. Cl.

| | |
|---|---|
| ***F04B 43/073*** | (2006.01) |
| ***F04B 49/00*** | (2006.01) |
| ***F04B 49/08*** | (2006.01) |
| ***F04B 53/12*** | (2006.01) |
| ***F04B 53/16*** | (2006.01) |

(52) U.S. Cl.
CPC ..... *F04B 49/002* (2013.01); *F04B 49/08* (2013.01); *F04B 53/12* (2013.01); *F04B 53/16* (2013.01)

(58) Field of Classification Search
USPC ..... 417/383, 385, 388
See application file for complete search history.

(56) References Cited

U.S. PATENT DOCUMENTS

| | | | | |
|---|---|---|---|---|
| 5,624,246 | A | 4/1997 | Kuhlenschmidt | |
| 6,071,089 | A * | 6/2000 | Maier | F02M 59/14 417/388 |
| 6,174,144 | B1 * | 1/2001 | van Hamme | F04B 43/067 417/339 |
| 6,554,578 | B1 | 4/2003 | Siegel | |
| 2012/0011998 | A1 | 1/2012 | Johansson et al. | |

FOREIGN PATENT DOCUMENTS

| | | | |
|---|---|---|---|
| RU | 2015129692 | A | 1/2017 |
| WO | 2020250042 | A1 | 12/2020 |

* cited by examiner

MEMBRANE-BASED PISTON PUMP AND A HOMOGENISING APPARATUS COMPRISING THE MEMBRANE-BASED PISTON PUMP

TECHNICAL FIELD

The present invention relates to a membrane-based piston pump and a homogenising apparatus comprising the membrane-based piston pump. The invention proposed here is used in the food industry, in particular in the dairy sector. The invention can also be used in the chemical, pharmaceutical or cosmetic industry.

Even though in varying, currently known embodiments, a homogenising apparatus comprises a high-pressure pump and a homogenising valve that act on the fluid products containing particles in order to:

- crush the particles to make their dimensions uniform, reducing the average size and the variance of the distribution in order to stabilise the product and to increase its shelf-life in the case of emulsions;
- break the cell membranes in order to facilitate the extraction of the active ingredients in the case of pharmaceutical applications;
- modify the structure of the particles in the case of chemical applications and cellulose.

In this context, the attention is focused on the pumping system.

BACKGROUND ART

The use of membrane (or diaphragm) pumps is known that employ a flexible member—precisely the "membrane" or "diaphragm"- for transmitting the pulsing force to the fluid to homogenise, ensuring the separation of the fluid itself with respect to the (contaminated) outside environment.

For example, document US 2012/0011998 shows a membrane pump in which the flexible member acts as a separator element between a containment chamber of the fluid to homogenise and a hydraulic chamber, containing oil, in which a piston is housed.

In the known solutions, the integrity of the membrane may be challenged during the cleaning of the system with a cleaning fluid at a pressure reaching 50 bar. This can lead to a quick wear and even a break of the membrane.

DISCLOSURE OF THE INVENTION

In this context, the technical task at the basis of the present invention is to propose a membrane-based piston pump and a homogenising apparatus comprising the membrane-based piston pump, which overcome the above-mentioned drawbacks of the prior art.

In particular, the object of the present invention is to propose membrane-based piston pump where the integrity of the membrane is preserved also during cleaning or maintenance operation.

Another object of the present invention is to propose a membrane-based piston pump and a homogenising apparatus comprising the membrane-based piston pump that are compact and modular.

The stated technical task and specified objects are substantially achieved by a membrane-based piston pump for use in a homogenising apparatus, comprising:

- a membrane means separating a product side for a fluid product from a hydraulic side for a hydraulic fluid;

- a reciprocating piston operatively active on the hydraulic fluid;
- valve means configured to establish a selective fluid communication between the hydraulic side and a tank containing the hydraulic fluid, wherein the valve means comprise:

- a first valve arrangement that, in a working condition of the piston pump, is configured to discharge the hydraulic fluid having a pressure over a first predefined threshold from the hydraulic side towards the tank and to draw the hydraulic fluid from the tank to the hydraulic side in response to a pressure in the hydraulic side dropping below a second predefined threshold;
- a second valve arrangement that, in at least one non-working condition of the piston pump, is configured to discharge the hydraulic fluid having a pressure over a third predefined threshold from the hydraulic side towards the tank.

According to one aspect of the invention, the non-working condition is a maintenance condition.

According to one aspect of the invention, the non-working condition is a cleaning condition.

According to one aspect of the invention, the first predefined threshold is comprised between 50 bar and 450 bar, and the third predefined threshold is comprised between 5 bar and 50 bar.

According to one embodiment of the invention, the first valve arrangement comprises a first overpressure valve and an anti-cavitation valve.

In particular, in the working condition of the piston pump, the first overpressure valve is configurable in:

- an open position in response to the hydraulic fluid having a pressure over the first predefined threshold so as to discharge the hydraulic fluid from the hydraulic side towards the tank;
- a closed position in response to the hydraulic fluid having a pressure under the first predefined threshold.

In the working condition of the piston pump, the anti-cavitation valve is configurable in:

- an open position in response to the hydraulic fluid in the hydraulic side dropping below the second predefined threshold;
- a closed position in response to the hydraulic fluid in the hydraulic side being over the second predefined threshold.

According to one embodiment, the second valve arrangement comprises a second overpressure valve that, in the non-working condition of the piston pump, is configurable in:

- an open position in response to the hydraulic fluid having a pressure over the third predefined threshold so as to discharge the hydraulic fluid from the hydraulic side towards the tank;
- a closed position in response to the hydraulic fluid having a pressure under the third predefined threshold.

Preferably, the second valve arrangement comprises a check valve that, in the working condition of the piston pump, is configured to prevent a flow of the hydraulic fluid from the hydraulic side towards the tank.

The second overpressure valve is interposed between the tank and the check valve.

According to one embodiment, the membrane-based piston pump further comprises:

- a membrane body housing the membrane means and a product chamber for the fluid product, the product chamber being obtained in the product side;

a pump body housing a hydraulic chamber for the hydraulic fluid, the piston being partially housed in the hydraulic chamber and slidably mounted therein;

a pipe interposed between the membrane body and the pump body, the pipe having a first end that emerges in the hydraulic side of membrane body and a second end that emerges in the hydraulic chamber, the valve means being configured to establish a selective fluid communication between the hydraulic chamber and the tank and/or between the pipe and the tank.

According to one embodiment, the membrane-based piston pump further comprises:

a single body housing the membrane means, a product chamber for the fluid product obtained in the product side, a hydraulic chamber for the hydraulic fluid obtained in the hydraulic side, the piston being partially housed in the hydraulic chamber and slidably mounted therein.

According to one embodiment, the membrane-based piston pump further comprises a valve body that houses both the first valve arrangement and the second valve arrangement.

According to one embodiment, the membrane-based piston pump further comprises a first valve body housing the first valve arrangement and a second valve body housing the second valve arrangement.

BRIEF DESCRIPTION OF DRAWINGS

Further characteristics and advantages of the present invention will more fully emerge from the non-limiting description of a preferred but not exclusive embodiment of a membrane-based piston pump and a homogenising apparatus comprising the membrane-based piston pump, as depicted in the attached figures.

DETAILED DESCRIPTION OF PREFERRED EMBODIMENTS OF THE INVENTION

Figure 1:
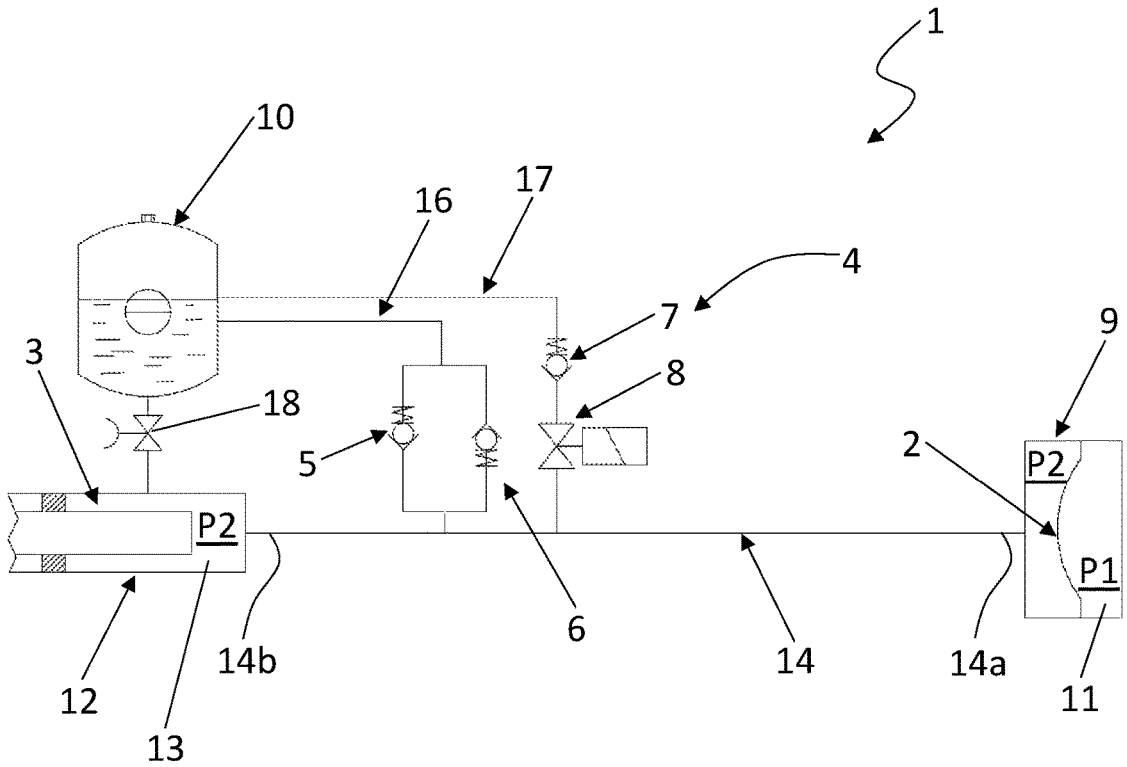
FIG. 1 illustrates the hydraulic circuit of a membrane-based piston pump, according to the present invention.

With reference to the figures, number 1 indicates a membrane-based piston pump 1, also shortly referred to as "piston pump" in the following disclosure.

The piston pump 1 comprises a membrane means 2 separating a product side for a fluid product P1 from a hydraulic side for a hydraulic fluid P2 (i.e., oil).

According to an aspect of the invention, the membrane means 2 comprise a single layer.

According to another aspect of the invention, the membrane means 2 comprise two layers mutually spaced in such a way as to define an intermediate chamber comprising a service fluid.

The layers of the membrane means are preferably made by a polymeric material, i.e. PTFE.

The piston pump 1 further comprises a reciprocating piston 3 operatively active on the hydraulic fluid P2.

The piston pump 1 comprises also valve means 4 configured to establish a selective fluid communication between the hydraulic side and a tank 10 containing the hydraulic fluid P2.

The piston pump 1 may be operated in a working condition and at least in a non-working condition, as it will be explained hereafter.

The valve means 4 comprise a first valve arrangement 5, 6 that, in a working condition of the piston pump 1, is configured to discharge the hydraulic fluid P2 having a pressure over a first predefined threshold from the hydraulic side towards the tank 10 and to draw the hydraulic fluid P2 from the tank 10 to the hydraulic side in response to a pressure in the hydraulic side 4 dropping below a second predefined threshold.

According to an aspect of the invention, the first predefined threshold is comprised between 50 bar and 450 bar in order to counter-balance the pressure of the fluid product (to be homogenized) in the product side.

According to one embodiment, the second threshold coincides with the first threshold.

The valve means 4 comprise also a second valve arrangement 7, 8 that, in at least one non-working condition of the piston pump 1, is configured to discharge the hydraulic fluid P2 having a pressure over a third predefined threshold from the hydraulic side 4 towards the tank 10.

According to an aspect of the invention, the third predefined threshold is comprised between 5 bar and 50 bar.

The first valve arrangement 5, 6 comprises a first overpressure valve 5 and an anti-cavitation valve 6.

In the working condition of the piston pump 1, the first overpressure valve is configurable in:

an open position in response to the hydraulic fluid P2 having a pressure over the first predefined threshold so as to discharge the hydraulic fluid P2 from the hydraulic side towards the tank 10;

a closed position in response to the hydraulic fluid P2 having a pressure under the first predefined threshold.

In the working condition of the piston pump 1, the anti-cavitation valve 6 is configurable in:

an open position in response to the hydraulic fluid P2 in the hydraulic side dropping below the second predefined threshold;

a closed position in response to the hydraulic fluid P2 in the hydraulic side being over the second predefined threshold. In particular, during the working condition the first overpressure valve 5 and the anti-cavitation valve 6 are controlled in such a way that only one may be open, i.e. they cannot be open both at the same time.

In non-working conditions of the piston pump 1, the first overpressure valve 5 and the anti-cavitation valve 6 are configurable in the closed position due to the pressure in the hydraulic side be lower than the second threshold and lower than the third threshold.

The second valve arrangement 7, 8 comprises a second overpressure valve 7 and a check valve 8.

The second overpressure valve 7 is interposed between the tank 10 and the check valve 8.

In a non-working condition of the piston pump 1, the second overpressure valve 7 is configurable in:

an open position in response to the hydraulic fluid P2 having a pressure over the third predefined threshold so as to discharge the hydraulic fluid P2 from the hydraulic side towards the tank 10;

a closed position in response to the hydraulic fluid P2 having a pressure under the third predefined threshold.

In the working condition of the piston pump 1, the check valve 8 is configured to prevent a flow of the hydraulic fluid P2 from the hydraulic side towards the tank 10.

Figure 2:
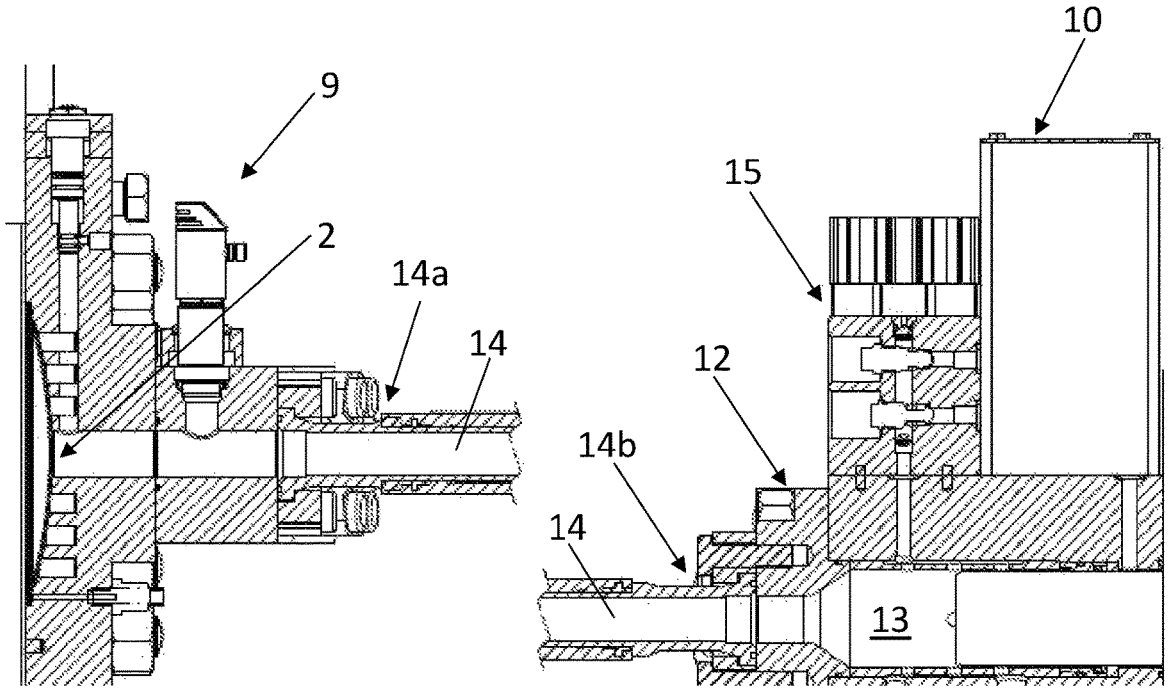
FIG. 2 illustrates a section of the membrane-based piston pump of FIG. 1 and the distribution of its components thereof.

According to the embodiment of FIG. 2, the piston pump 1 comprises a membrane body 9 and a pump body 12.

The membrane body 9 houses the membrane means 2 and a product chamber 11 for the fluid product P1. The product chamber 11 is obtained in the product side.

The pump body 12 houses a hydraulic chamber 13 for the hydraulic fluid P2.

The piston 3 is partially housed in the hydraulic chamber 13 and slidably mounted therein.

The membrane body 9 and the pump body 12 are connected by a pipe 14. The pipe 14 has a first end 14*a* that emerges in the hydraulic side of membrane body 9 and a second end 14*b* that emerges in the hydraulic chamber 13.

The valve means 4 is configured to establish a selective fluid communication between the hydraulic chamber 13 and the tank 10 and/or between the pipe 14 and the tank 10.

In this embodiment, the membrane body 9 is remotely connected to the pump body 12.

According to another embodiment (not shown), the piston pump 1 comprises a single body housing the membrane means 2, a product chamber 11 for the fluid product P1 obtained in the product side and a hydraulic chamber 13 for the hydraulic fluid P2 obtained in the hydraulic side.

The piston 3 is partially housed in the hydraulic chamber 13 and slidably mounted therein.

The piston pump 1 comprises a further valve 18 configured to allow the selective fluid communication between the tank 10 and the hydraulic chamber 13 before starting the operate the piston pump 1.

This valve 18 can be a check valve or a manually operated valve or a gate valve operated via control means.

Figure 3:
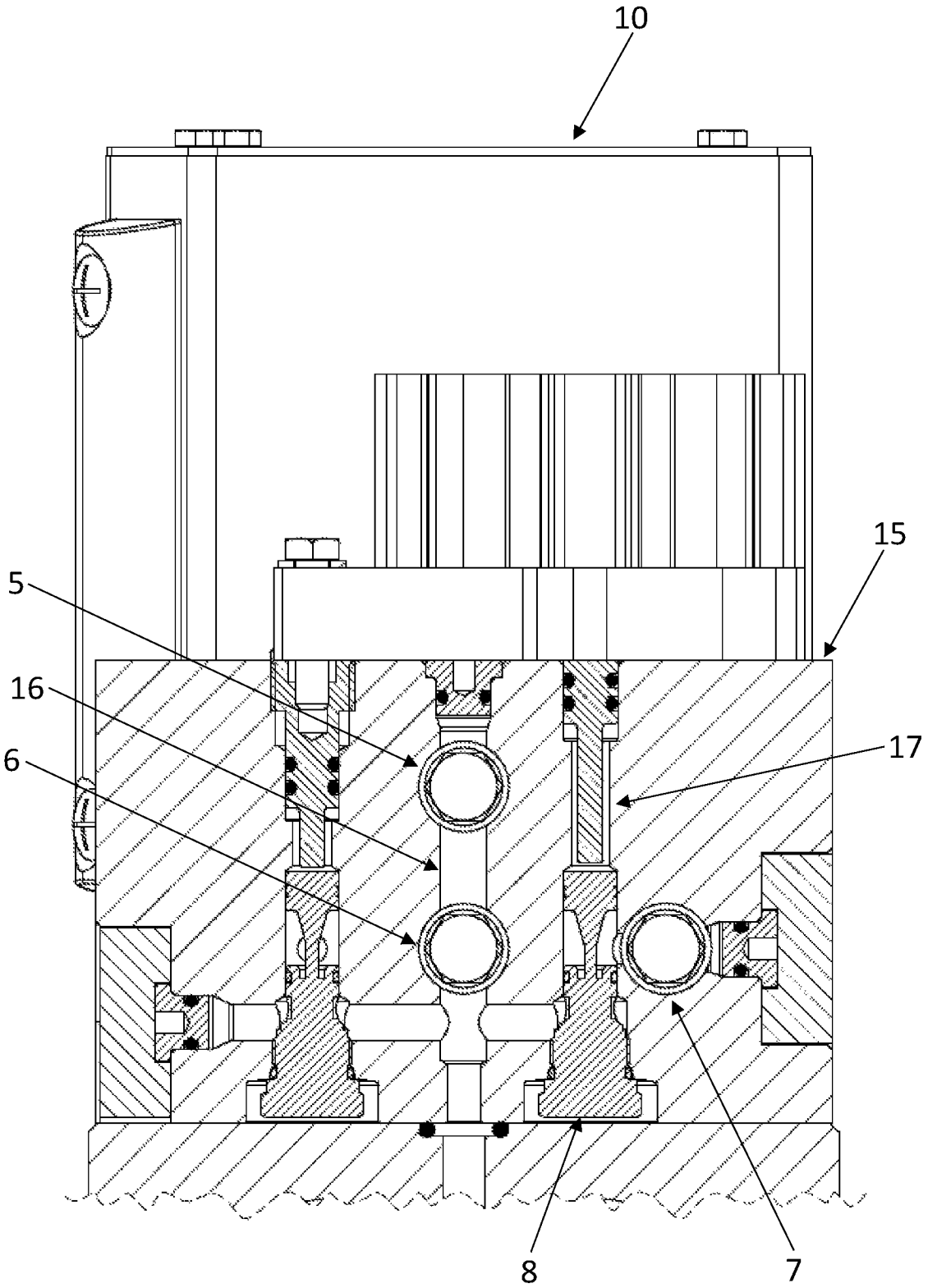
FIG. 3 illustrates a part (valve body) of the membrane-based piston pump.
Figure 4:
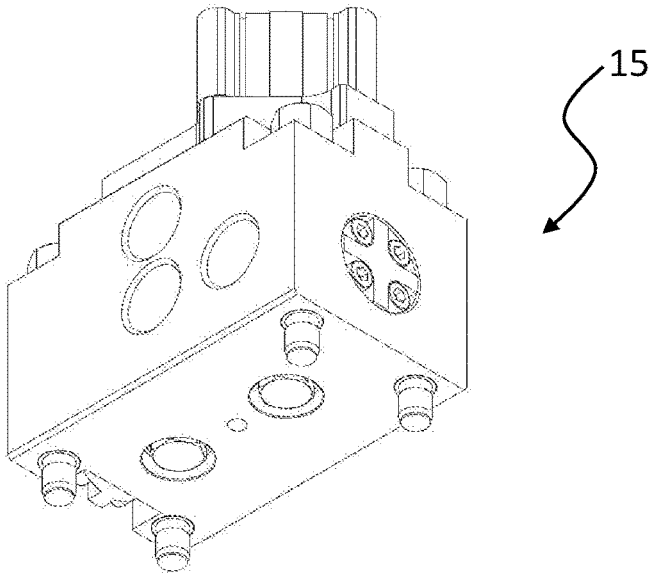
FIG. 4 illustrates the valve body of FIG. 3.

According to the embodiment illustrated in FIGS. 3 and 4, the piston pump 1 comprises a valve body 15 that houses both the first valve arrangement 5, 6 and the second valve arrangement 7, 8.

In particular, the first overpressure valve 5 and the anti-cavitation valve 6 are located along a first channel 16 extending from the tank 10 to the hydraulic chamber 13 (or the pipe 14).

The check valve 8 is located along a second channel 17 to establish a communication between the tank 10 and the hydraulic chamber 13 (or the pipe 14). The second channel 17 is distinct (separated) from the first channel 16.

According to another embodiment (not shown), the piston pump 1 comprises a first valve body housing the first valve arrangement 5, 6 and a second valve body housing the second valve arrangement 7, 8. The first valve body and the second valve body are thus distinct bodies that may be mounted close, i.e. packed together.

The functioning of the membrane-based piston pump according to the present invention, is explained below.

The piston pump 1 is in working condition, with the product chamber 11 filled with the product fluid P1 to be homogenized.

During the working condition of the piston pump 1, the first overpressure valve 5 is configurable either in an open position or in a closed position depending on the pressure value of the hydraulic fluid P2 in the hydraulic chamber (or in the pipe 4).

In particular, until the pressure value of the hydraulic fluid P2 remains under the first predefined threshold, the first overpressure valve 5 does not intervene, that means it is maintained in the closed position.

As soon as the pressure value of the hydraulic fluid P2 in the hydraulic chamber 13 (or in the pipe 4) raises over the first predefined threshold, the first overpressure valve 5 passes to the open position so as to establish a fluid communication between the hydraulic chamber 13 (or the pipe 14) and the tank 10, thus allowing the discharge of the hydraulic fluid P2 from the hydraulic chamber 13 (or the pipe 14) towards the tank 10.

In particular, an amount of the hydraulic fluid P2 is discharged from the hydraulic chamber 13 (or from the pipe 14) 4 to the tank 10 by means of the first channel 16, until the pressure value of the hydraulic fluid P2 in the hydraulic chamber 13 (or in the pipe 14) lowers down the first threshold.

During the working condition of the piston pump 1, the anti-cavitation valve 6 is configurable either in an open position or in a closed position, depending on the pressure value of the hydraulic fluid P2 in the hydraulic chamber 13 (or in the pipe 14).

In particular, until the pressure value of the hydraulic fluid P2 in the hydraulic chamber 13 (or in the pipe 14) remains above the second predefined threshold, the anti-cavitation valve 6 does not intervene, that means it is maintained in the closed position.

As soon as the pressure value of the hydraulic fluid P2 in the hydraulic chamber 13 (or in the pipe 14) drops below the second predefined threshold, the anti-cavitation valve 6 passes to the open position so as to establish the fluid communication between the hydraulic chamber 13 (or the pipe 14) and the tank 10, thus allowing to draw more hydraulic fluid P2 from the tank 10 to the hydraulic chamber 13 (or to the pipe 14).

In particular, an amount of the hydraulic fluid P2 is filled in the hydraulic chamber 13 from to the tank 10 by means of the first channel 16, until the pressure value of the hydraulic fluid P2 in the hydraulic chamber 13 (or in the pipe 14) reaches the second threshold. For example, a drop of the pressure valve below the second predefined threshold may occur in case of leakages.

When the piston pump 1 is the working condition, the check valve 8 is closed so that the fluid communication of the hydraulic chamber 13 with the tank 10 along the second channel 17 is interrupted.

Thus, the second overpressure valve 7 does not intervene, that means it is maintained in the closed position.

When the piston pump 1 needs to be cleaned, it is operated in a non-working condition (that is for example a cleaning condition)

The piston pump 1 is in the cleaning condition during a CIP cycle, wherein the product chamber 11 is filled with a cleaning fluid.

According to another embodiment of the invention, the non-working condition is a maintenance condition. When the piston pump 1 is in a non-working condition, the first overpressure valve 5 and the anti-cavitation valve 6 are configured in the closed position.

On the second channel 17, the check valve 8 is open, that means it allows a fluid communication between the hydraulic chamber 13 and the tank 10. The second overpressure valve 7 is configurable either in an open position or in a closed position depending on the pressure value of the hydraulic fluid P2 in the hydraulic chamber 13 (or in the pipe 14).

In particular, until the pressure value of the hydraulic fluid P2 in the hydraulic chamber 13 (or in the pipe 14) remains under the third predefined threshold, the secondo overpressure valve 7 remains in the closed position.

As soon as the pressure value of the hydraulic fluid P2 in the hydraulic chamber 13 (or in the pipe 14) raises over the third predefined threshold, the second overpressure valve 7 passes to the open position so as to establish a fluid communication between the second hydraulic chamber 13 (or the pipe 14) and the tank 10, thus allowing the discharge of the hydraulic fluid P2 from the hydraulic chamber 13 (or from the pipe 14) towards the tank 10.

In particular, an amount of the hydraulic fluid P2 is discharged from the hydraulic chamber 13 (or from the pipe 14) to the tank 10 by means of the second channel 17, until the pressure value of the hydraulic fluid P2 in the hydraulic chamber 13 (or in the pipe 4) lowers down the third threshold.

In case the non-working condition is a cleaning condition, the second overpressure valve 7 is acted so as to counter-balance the pressure of the cleaning fluid in the product chamber 11 (that is comprised between 15 bar and 50 bar).

Figure 5:
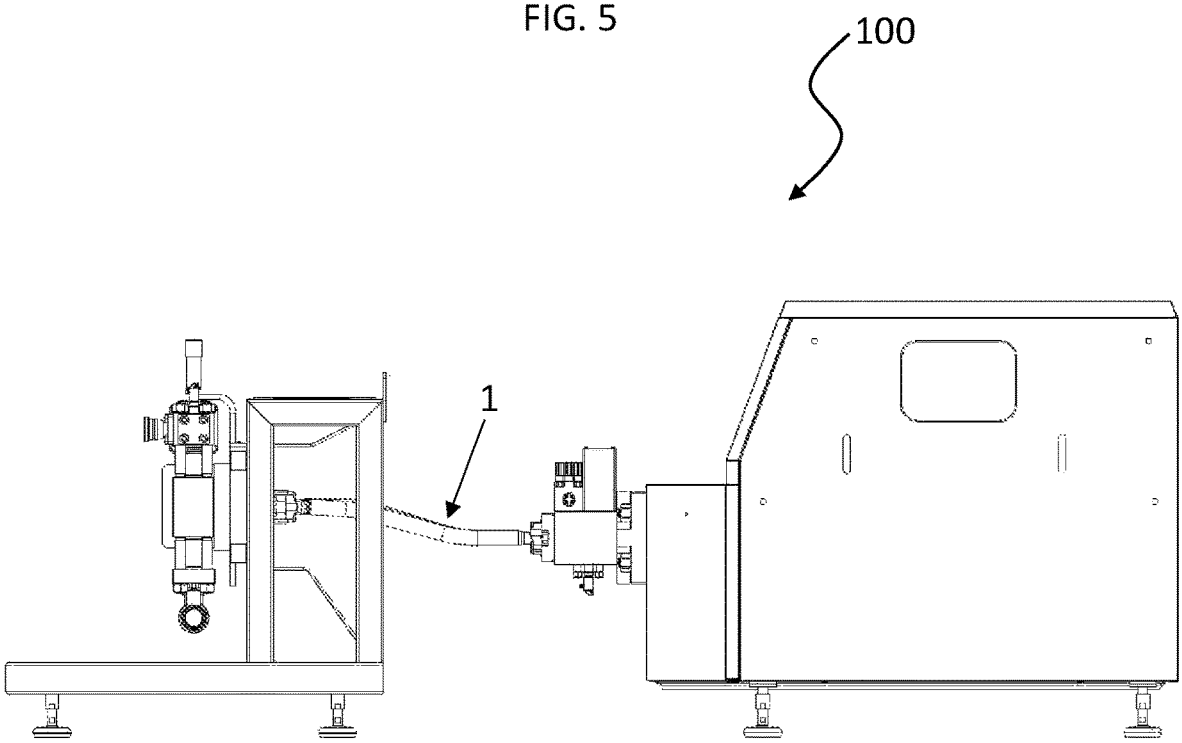
FIG. 5 illustrates a homogenizing apparatus, according to the present invention.

In FIG. 5 it is illustrated a homogenising apparatus 100 comprising:

- a plurality of membrane-based piston pumps 1 (as described above);
- a homogenising valve arranged downstream of the membrane-based piston pumps;
- actuation means configured to reciprocate the pistons 3 of the membrane-based piston pumps 1.

Figure 6:
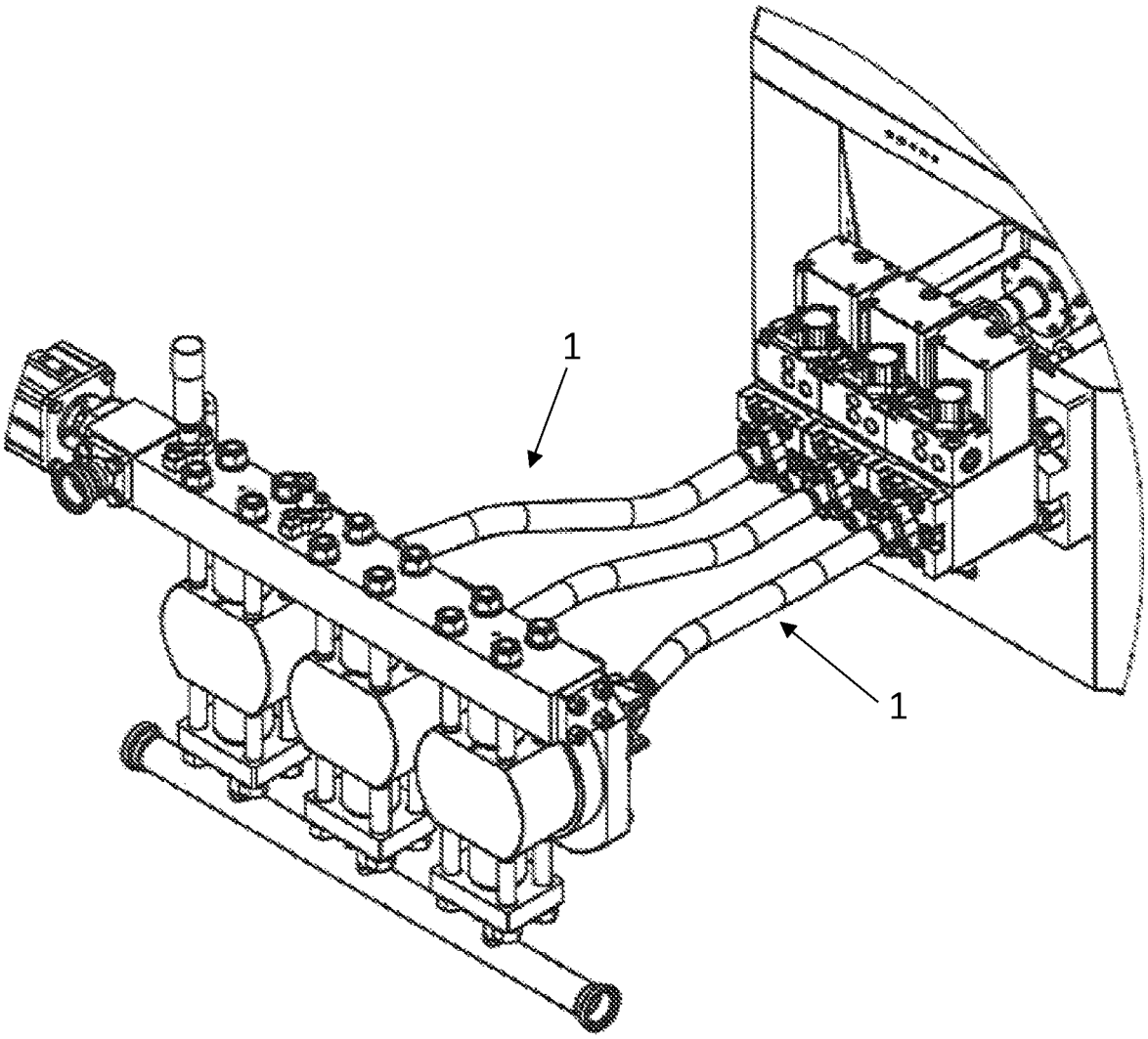
FIG. 6 illustrates the membrane-based piston pumps of the homogenizing apparatus of FIG. 5.

As can be seen from FIG. 6, the plurality of membrane-based piston pumps 1 are arranged one beside the others, with the corresponding pipes 14 forming a bundle.

The characteristics and the advantages of a membrane-based piston pump and a homogenising apparatus comprising the membrane-based piston pump, according to the present invention, are clear, as are the advantages.

Thanks to the presence of the second valve arrangement that allows to discharge the hydraulic fluid from the hydraulic side in order to counter-balance the pressure of the cleaning fluid in the product side, the stress on the membrane is maintained under control during cleaning or maintenance operations.

In particular, there is avoided to reach a value of pressure that may break or damage the membrane means, that would require to stop the apparatus and substitute said means.

Furthermore, the piston pump is compact since the valve arrangements may be housed in the same valve body.

This also results in a compact and modular homogenising apparatus.

Terms used herein and especially in the appended claims (e.g., bodies of the appended claims) are generally intended as "open" terms (e.g., the term "including" should be interpreted as "including, but not limited to," the term "having" should be interpreted as "having at least," the term "includes" should be interpreted as "includes, but is not limited to," etc.).

Additionally, if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations.

In addition, even if a specific number of an introduced claim recitation is explicitly recited, it is understood that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." or "one or more of A, B, and C, etc." is used, in general such a construction is intended to include A alone, B alone, C alone, A and B together, A and C together, B and C together, or A, B, and C together, etc. For example, the use of the term "and/or" is intended to be construed in this manner.

Further, any disjunctive word or phrase presenting two or more alternative terms, whether in the description, claims, or drawings, should be understood to contemplate the possibilities of including one of the terms, either of the terms, or both terms. For example, the phrase "A or B" should be understood to include the possibilities of "A" or "B" or "A and B."

Additionally, the use of the terms "first," "second," "third," etc., are not necessarily used herein to connote a specific order or number of elements. Generally, the terms "first," "second," "third," etc., are used to distinguish between different elements as generic identifiers. Absence a showing that the terms "first," "second," "third," etc., connote a specific order, these terms should not be understood to connote a specific order. Furthermore, absence a showing that the terms first," "second," "third," etc., connote a specific number of elements, these terms should not be understood to connote a specific number of elements. For example, a first widget may be described as having a first side and a second widget may be described as having a second side. The use of the term "second side" with respect to the second widget may be to distinguish such side of the second widget from the "first side" of the first widget and not to connote that the second widget has two sides.

All examples and conditional language recited herein are intended for pedagogical objects to aid the reader in understanding the invention and the concepts contributed by the inventor to furthering the art, and are to be construed as being without limitation to such specifically recited examples and conditions. Although embodiments of the present disclosure have been described in detail, it should be understood that the various changes, substitutions, and alterations could be made hereto without departing from the spirit and scope of the present disclosure.

The invention claimed is:

1. A membrane-based piston pump for use in a homogenising apparatus, comprising:

- a membrane separating a product side for a fluid product from a hydraulic side for a hydraulic fluid an oil;
- a reciprocating piston operatively active on the hydraulic fluid oil; and
- a valve system configured to establish a selective fluid communication between the hydraulic side and a tank containing the hydraulic fluid oil, wherein said valve system comprises:

- a first valve arrangement that, in a working condition of said piston pump, is configured to discharge the hydraulic fluid oil having a pressure over a first predefined threshold from the hydraulic side towards the tank and to draw the hydraulic fluid oil from the tank to the hydraulic side in response to a pressure in the hydraulic side dropping below a second predefined threshold, wherein the first valve arrangement comprises a first overpressure valve and an anti-cavitation valve; and a second valve arrangement that, in at least one non-working condition of said piston pump, is configured to discharge the hydraulic fluid oil having a pressure over a third predefined threshold from the hydraulic side towards the tank, wherein the first predefined threshold is between 50 bar and 450 bar and the third predefined threshold is between 5 bar and 50 bar, wherein the second valve arrangement comprises a second overpressure valve that, in the at least one non-working condition of the piston pump, is moved to:

an open position in response to the oil having a pressure over the third predefined threshold so as to discharge the oil from the hydraulic side towards the tank; and a closed position in response to the oil having a pressure under the third predefined threshold, said second overpressure valve passing from the closed position to the open position and vice versa depending on the pressure value of the oil in a hydraulic chamber containing the oil and partially housing the reciprocating piston.

2. The membrane-based piston pump according to claim 1, wherein the non-working condition is a maintenance condition.

3. The membrane-based piston pump according to claim 1, wherein the non-working condition is a cleaning condition.

4. The membrane-based piston pump according to claim 1, wherein in the working condition of the piston pump, the first overpressure valve is configurable in:

an open position in response to the hydraulic fluid oil having a pressure over the first predefined threshold so as to discharge the hydraulic fluid oil from the hydraulic side towards the tank; and a closed position in response to the hydraulic fluid oil having a pressure under the first predefined threshold.

5. The membrane-based piston pump according to claim 1, wherein in the working condition of the piston pump, the anti-cavitation valve is configurable in:

an open position in response to the hydraulic fluid oil in the hydraulic side dropping below the second predefined threshold; and a closed position in response to the hydraulic fluid oil in the hydraulic side being over the second predefined threshold.

6. The membrane-based piston pump according to claim 1, wherein the second valve arrangement comprises a check valve that, in the working condition of said piston pump, is configured to prevent a flow of the hydraulic fluid oil from the hydraulic side towards the tank, the second overpressure valve being interposed between the tank and said check valve.

7. The membrane-based piston pump according to claim 1, further comprising:

a membrane body housing the membrane and a product chamber for the fluid product, said product chamber being obtained in the product side;

a pump body housing a hydraulic chamber for the hydraulic fluid oil, the reciprocating piston being partially housed in the hydraulic chamber and slidably mounted therein; and a pipe interposed between the membrane body and the pump body, said pipe having a first end that emerges in the hydraulic side of membrane body and a second end that emerges in the hydraulic chamber, said valve system being configured to establish a selective fluid communication between the hydraulic chamber and the tank and/or between the pipe and the tank.

8. The membrane-based piston pump according to claim 1, further comprising:

a single body housing the membrane, a product chamber for the fluid product obtained in the product side, a hydraulic chamber for the hydraulic fluid oil obtained in the hydraulic side, the piston being partially housed in the hydraulic chamber and slidably mounted therein.

9. The membrane-based piston pump according to claim 1, further comprising a valve body that houses both the first valve arrangement and the second valve arrangement.

10. The membrane-based piston pump according to claim 1, further comprising a first valve body housing the first valve arrangement and a second valve body housing the second valve arrangement.

11. A homogenising apparatus comprising:

a plurality of membrane-based piston pumps, each of the plurality of membrane-based piston pumps comprising:

a membrane separating a product side for a fluid product from a hydraulic side for an hydraulic fluid oil;

a reciprocating piston operatively active on the hydraulic fluid oil; and a valve system configured to establish a selective fluid communication between the hydraulic side and a tank containing the hydraulic fluid oil, wherein the valve system comprises:

a first valve arrangement that, in a working condition of said piston pump, is configured to discharge the hydraulic fluid oil having a pressure over a first predefined threshold from the hydraulic side towards the tank and to draw the hydraulic fluid oil from the tank to the hydraulic side in response to a pressure in the hydraulic side dropping below a second predefined threshold, wherein the first valve arrangement of each of the plurality of membrane-based piston pumps comprises a first overpressure valve and an anti-cavitation valve; and a second valve arrangement that, in at least one non-working condition of said piston pump, is configured to discharge the hydraulic fluid oil having a pressure over a third predefined threshold from the hydraulic side towards the tank, wherein the first predefined threshold is comprised between 50 bar and 450 bar and the third predefined threshold is comprised between 5 bar and 50 bar, wherein the second valve arrangement comprises a second overpressure valve that, in the at least one non-working condition of the piston pump, is moved to:

an open position in response to the oil having a pressure over the third predefined threshold so as to discharge the oil from the hydraulic side towards the tank; and a closed position in response to the oil having a pressure under the third predefined threshold, said second overpressure valve passing from the closed position to the open position and vice versa depending on the pressure value of the oil in a hydraulic chamber containing the oil and partially housing the reciprocating piston;

a homogenising valve arranged downstream of said membrane-based piston pumps; and an actuator configured to reciprocate the reciprocating pistons of the membrane-based piston pumps.

12. The homogenising apparatus according to claim 11, wherein in the working condition of each of the membrane-based piston pumps, the first overpressure valve is configurable in:

an open position in response to the hydraulic fluid oil having a pressure over the first predefined threshold so as to discharge the hydraulic fluid oil from the hydraulic side towards the tank; and a closed position in response to the hydraulic fluid oil having a pressure under the first predefined threshold.

13. The homogenising apparatus according to claim 11, wherein in the working condition of each of the membrane-based piston pumps, the anti-cavitation valve is configurable in:

an open position in response to the hydraulic fluid oil in the hydraulic side dropping below the second predefined threshold; and a closed position in response to the hydraulic fluid oil in the hydraulic side being over the second predefined threshold.

14. The homogenising apparatus according to claim 11, wherein the second valve arrangement of each of the membrane-based piston pumps comprises a second overpressure valve that, in the at least one non-working condition of each of the membrane-based piston pump, is configurable in:

an open position in response to the hydraulic fluid oil having a pressure over the third predefined threshold so as to discharge the hydraulic fluid oil from the hydraulic side towards the tank; and a closed position in response to the hydraulic fluid oil having a pressure under the third predefined threshold.

15. The homogenising apparatus according to claim 14, wherein the second valve arrangement of each of the membrane-based piston pumps comprises a check valve that, in the working condition of each of said membrane-based piston pumps, is configured to prevent a flow of the hydraulic fluid oil from the hydraulic side towards the tank, the second overpressure valve being interposed between the tank and said check valve.

16. The homogenising apparatus according to claim 11, wherein each of the membrane-based piston pumps further comprises:

a membrane body housing the membrane;

a product chamber for the fluid product, said product chamber being obtained in the product side;

a pump body housing a hydraulic chamber for the hydraulic fluid oil, the reciprocating piston being partially housed in the hydraulic chamber and slidably mounted therein; and a pipe interposed between the membrane body and the pump body, said pipe having a first end that emerges in the hydraulic side of membrane body and a second end that emerges in the hydraulic chamber, said valve system being configured to establish a selective fluid communication between the hydraulic chamber and the tank and/or between the pipe and the tank.

* * * * *